United States Patent [19]

Kosman

[11] Patent Number: 4,848,208

[45] Date of Patent: Jul. 18, 1989

[54] AUTOMATED METHOD AND SYSTEM FOR ENGAGING MULTIPLE PURSUERS WITH MULTIPLE TARGETS

[75] Inventor: Wayne R. Kosman, Simi Valley, Calif.

[73] Assignee: Hughes Aircraft Company, Los Angeles, Calif.

[21] Appl. No.: 57,543

[22] Filed: Jun. 3, 1987

[51] Int. Cl.[4] ..... F41G 9/00

[52] U.S. Cl. ..... 89/1.11; 244/3.1; 244/3.15

[58] Field of Search ..... 89/1.11; 244/3.1, 3.15, 244/3.16, 3.19

[56] References Cited

U.S. PATENT DOCUMENTS 4,004,487 1/1977 Eichweber ..... 244/3.15

4,611,772 9/1986 Stesson ..... 244/3.15

*Primary Examiner*—Charles T. Jordan

*Attorney, Agent, or Firm*—M. W. Sales; R. A. Hays; A. W. Karambelas

[57] ABSTRACT

A plurality of pursuers or defensive missiles which are self-guided and self-propelled individually assign themselves to one of a plurality of targets or incoming offensive missiles in such a manner that the probability is substantially increased that more targets will be selected by at least one pursuer and that fewer targets will be selected by more than one pursuer.

21 Claims, 2 Drawing Sheets

AUTOMATED METHOD AND SYSTEM FOR ENGAGING MULTIPLE PURSUERS WITH MULTIPLE TARGETS

BACKGROUND OF THE INVENTION

1. Field of the Invention

The present invention relates to the field of self-guided pursuers or missiles and more particularly to a method and apparatus for independently self-assigning multiple pursuers to multiple targets with a uniform assignment of pursuers among targets.

2. Description of the Prior Art

Numerous methods and systems are known for assigning targets from a group of multiple targets among a corresponding group of multiple pursuers. Prior art systems have been devised which include guidance from one or more fixed ground or remote stations during the entire target tracking and assignment, or for incorporating an assignment protocol within each self-guided pursuer or missile. In the case where target tracking and target assignment are independently managed by the self-guided and propelled pursuers, independent of any remote station or guidance control, and further independent of any communication between the pursuers, some methodology is required to effect a coordinated response to a complex and dynamic target typology.

In such pursuer guidance and assignment protocols, the problem of efficient self-assignment is exacerbated by maneuverability of the target in three dimensions and further by a time dependent ability of the target tracking system within each pursuer to resolve the position, direction and velocity of each target in each dimension at a single point in time. Typically, target tracking systems and such self-guided pursuers are able to resolve target position in one dimension before the remaining dimensions. Therefore one must be able to devise an assignment protocol which allows for efficient self-assignment of the pursuers among the targets as the resolution of the targets' position improves as the point of convergence of pursuers and targets is approached.

What is needed is a methodology and apparatus in which the methodology may be efficiently performed to allow self-guided and self-assigned pursuers to be efficiently assigned to multiple targets so that a greater number of targets may be selected by at least one pursuer and a fewer number of targets will be selected by more than one pursuer.

BRIEF SUMMARY OF THE INVENTION

A plurality of pursuers or defensive missiles which are self-guided and self-propelled individually assign themselves to one of a plurality of targets or incoming offensive missiles in such a manner that the probability is substantially increased that more targets will be selected by at least one pursuer and that fewer targets will be selected by more than one pursuer. The targets are resolved by a computerized onboard radar system in a first dimension which dimension may be position, velocity or another target parameter. As soon as all the targets have been resolved in this first dimension, a preliminary assignment of the pursuers to the target is made. The targets thus may be identified in clusters in the first dimension while all other target dimensions remain unresolvable at the time of preliminary assignment. The pursuers are assigned to each of the clusters of targets as resolved in the first dimension in such a manner that no one cluster has more than one missile more than any other cluster. Thereafter, each cluster of targets is separately tracked by each of the pursuers, which do not communicate with any one of the other pursuers at any time. At some point during the tracking process, the pursuer may be able to resolve individual targets within its preliminarily assigned cluster in a second dimension. At that time targets assigned to that cluster are reassigned among the cluster targets as resolved in this dimension according to a predetermined protocol. Thereafter, each reassigned pursuer independently forms an intercept strategy with respect to its reassigned target within the cluster.

The invention is a method for use with a plurality of self-guided pursuers for self-assigning multiple targets grouped in clusters among multiple pursuers comprising the steps of resolving the multiple targets in an ordered sequence of elements mapped into a first dimension corresponding to the targets. The multiple pursuers are preliminarily and cyclically assigned to the elements of the ordered sequence of multiple targets. The multiple pursuer are cyclically assigned to the elements of the ordered sequence of targets. The highest ordered target is considered adjacent the lowest ordered target for purposes of the step of cyclically assigning. Each of the clusters of targets is resolved in a second dimension to form a similar ordered sequence of the targets within each cluster mapped in the second dimension. The pursuers which were preliminarily assigned to each cluster are then reassigned when the cluster is resolved into separate target elements by the step of resolving the cluster in the second dimension. As a result, the probability that more of the targets will be assigned to at least one of the pursuers and fewer ones of the targets will be selected by more than one of the pursuers is substantially increased.

The step of preliminarily assigning the pursuers to the targets comprises the steps of assigning a rank to each pursuer; comparing the rank of each pursuer against the number of elements within the ordered sequence in the first dimension; setting a flag if the rank exceeds the number of elements in the ordered sequence; and decrementing the rank by the number of elements in the ordered sequence to obtain a new value.

The method further includes the steps of substituting the new value for the rank of the pursuer and repeating the steps of comparing, setting and decrementing until the new value is less than or equal to the number of elements in the first ordered sequence.

The step of preliminarily assigning the pursuer to the targets includes the step of assigning the pursuer to one of the clusters within the first ordered sequence according to the rank of the pursuer.

The method further comprises the steps of using a pursuit strategy for each pursuer as applied to the cluster of targets according to the preliminary assignment; and testing the flag set during the step of setting when the step of resolving the targets in the cluster in the second dimension indicates two or more target within the cluster.

The step of reassigning the pursuers to targets within the cluster comprises the steps of: reassigning each pursuer, originally assigned to the cluster, to one of the targets within the cluster, the one target having the least magnitude in the second dimension, the pursuer reassigned if the flag corresponding to the pursuer is not set;

and reassigning each other pursuer to targets within the cluster having a magnitude in the second dimension greater than the least magnitude of the second dimension in the second ordered sequence if the corresponding flag of the pursuer is set.

The method may also include the step of using a final pursuit strategy within each the reassigned pursuer with respect to the newly resolved targets in the second dimension.

The invention can also be characterized as method for self-assigning a plurality of pursuers among a plurality of targets, wherein each pursuer is self-guided and does not communicate with other pursuers among the plurality of pursuers, and wherein each pursuer senses the magnitude of at least a first and second dimension of the targets. The method comprises the steps of resolving the plurality of targets into a subplurality of clusters mapped into the first dimension. The plurality of pursuers are preliminarily assigned among the resolved clusters of the targets resolved in the first dimension. Each of the clusters verified with respect to the first dimension is resolved into a plurality of separate targets mapped into the second dimension. The pursuers preliminarily assigned to each cluster are reassigned among the newly resolved targets mapped into the second dimension. An intercept strategy used to converge each of the pursuers with each of the reassigned targets.

In the step of preliminarily assigning the pursuers, the pursuers are distributed among the clusters of targets resolved in the first dimension so that no cluster has more than one more pursuer assigned thereto than that cluster of targets with the minimum number of pursuers assigned to it.

The invention is also an apparatus for use with a plurality of self-guided pursuers for self-assigning multiple targets grouped in clusters among multiple pursuers comprising a circuit for resolving the multiple targets in an ordered sequence of elements mapped into a first dimension corresponding to the targets. Also included is circuit for preliminarily and cyclically assigning the multiple pursuers to the elements of the ordered sequence of multiple targets. The circuit for assigning is coupled to the circuit for resolving in the first dimension. The multiple pursuers are cyclically assigned to the elements of the ordered sequence of targets. The highest ordered target is considered adjacent the lowest ordered target for purposes of the cyclically assigning. A circuit for resolving in a second dimension each of the clusters of targets to form a similar ordered sequence of the targets within each cluster mapped in the second dimension is similarly provided. A circuit for reassigning the pursuers preliminarily assigned to each cluster wherein the cluster is resolved into separate target elements by resolving the cluster in the second dimension is coupled to the circuit for resolving in the second dimension and to the circuit for assigning.

The invention and its various embodiments are best understood by now turning to the following Figures.

The invention and its various embodiments may be better understood by now turning to the following detailed description.

DETAILED DESCRIPTION OF THE PREFERRED EMBODIMENTS

The present invention is a method and apparatus for independent assignment of pursuers to targets in such a manner that the probability is increased that more targets will be selected by at least one pursuer and fewer targets will be selected by more than one pursuer.

Figure 1:
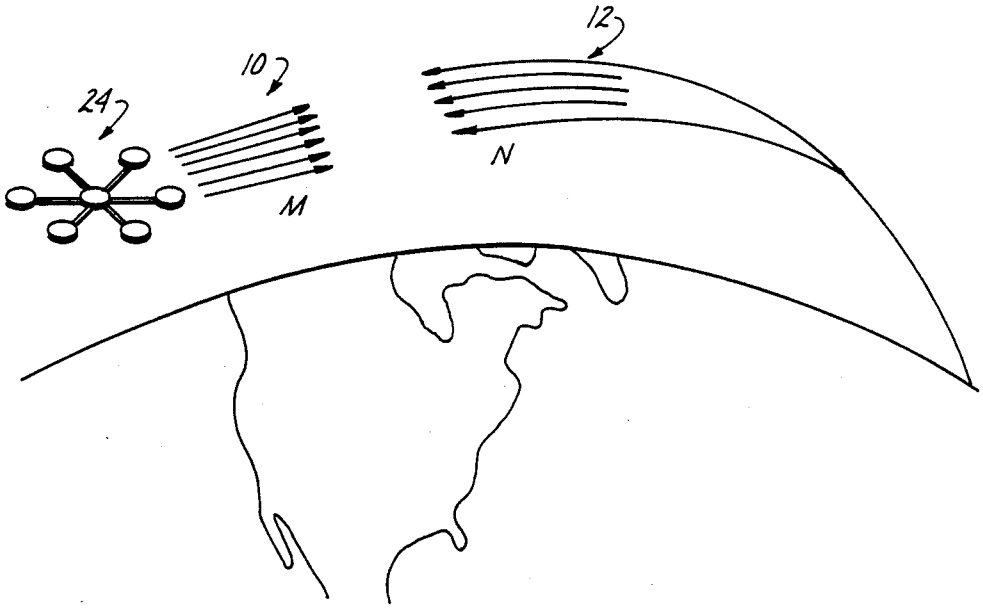
FIG. 1 is a diagrammatic depiction of a plurality of pursuers approaching a plurality of targets during the stage in which target resolution is improving and wherein each of the self guided pursuers is making a self-assignment to one of the detected targets.

Turn to FIG. 1 which is a diagrammatic depiction of M pursuers, generally denoted by reference numeral 10, having been launched and approaching an opposing plurality of N targets, generally indicated by reference numeral 12. In the diagrammatic depiction of FIG. 1 there are six arrows symbolically representing six pursuers and five arrows symbolically representing five targets. The number of pursuers, M, and targets, N, are arbitrary and there is no fixed relationship between the two.

For example, in any given situation M may be equal to, less than or greater than N. In any case, the number, N, of targets 12 is unknown to each pursuer 10. Similarly, each pursuer 10 is unaware of the total number, M, of pursuers 10. However, the Kth pursuer is aware that it is in fact the Kth pursuer and that there are at least K-1 other pursuers directed to targets 12. This is true for each of pursuers 10. Furthermore, there is no communication whatsoever between each of pursuers 10. Each pursuer, as described in greater detail in connection with FIG. 2, includes its own sensor which develops an analytical picture of the encounter with targets 12 over time. Finally, each pursuer is constrained to assign itself to one of targets 12 at a predetermined time before intercept of convergence. Preliminary assignment is made by each pursuer when its knowledge of the engagement indicates that all resolvable targets in the first dimension should have been included in the engagement picture. This decision is based upon an a priori knowledge of the sensor capabilities and expected target signature characteristics. For example, with a radar sensor, the preliminary assignment is not made until the range is such that all targets of the expected radar cross section should have been detected and included in the engagement picture or analysis. Thus, each pursuer has a fixed time limit in which it must make an assignment for itself among targets 12.

The problem which is solved by the present invention further assumes that all of targets 12 are associated loosely in a group and are all travelling in approximately the same direction. Each of pursuers 10 similarly has approximately the same trajectory prior to their self- assignment to individual ones of targets 12. Therefore, the target sensing system within each pursuer 10 will develop approximately the same picture or analysis of the engagement with targets 12 as a function of time.

The assignment strategy is independently implemented within each pursuer and improves the probability that each target 12 will be assigned a single pursuer 10. This reduces the waste of two pursuers being assigned to one target while another target may not be selected by any pursuer.

Figure 2:
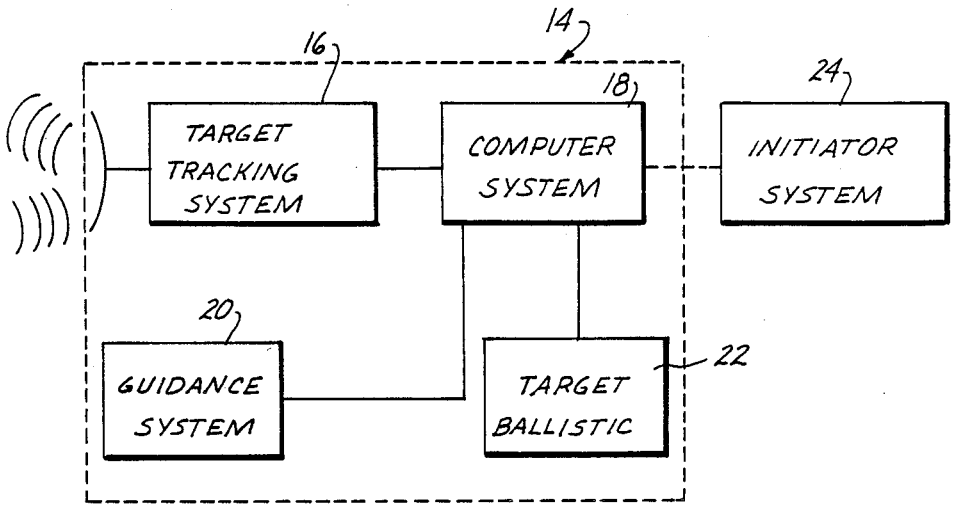
FIG. 2 is a schematic block diagram of an apparatus in which the methodology of the invention is practiced, which apparatus is included within each pursuer.

Turn now to FIG. 2 wherein a block diagram of circuitry within a single pursuer 14 of the plurality of pursuers 10 is diagrammatically depicted. Each pursuer 14 includes a sensor or target tracking system 16 which is capable of developing a picture or analysis of the encounter of pursuer 14 with targets 12 in at least two dimensions. A conventional MPRS (mono pulse radar system) is capable of this performance.

Target tracking system 16 is coupled to a conventional computer system 18 which may include external memory if necessary in the event that target tracking system 16 is incapable of seeing or analyzing the entire engagement between pursuer 14 and targets 12 at a single point in time. Computer system 18 is similarly coupled to and controls a conventional guidance system 20 within each pursuer 14. Guidance system 20 is a conventional system for controlling the attitude or movement of corresponding pursuer 14. Similarly, computer system 18 is coupled to and controls a conventional ballistic device 22 which can be selectively activated according to conventional principles to create a zone of destruction in the proximity of pursuer 14 upon the command of computer system 18. Ballistic device 22 may include conventional or nuclear explosives.

In some embodiments pursuer 14 may be associated with an initiator system 24 at least during an initial period prior to target assignment. In the diagrammatic depiction of FIG. 1 initiator 24 is generally depicted as the launch site of pursuers 10 and in FIG. 2 as a system communicating with computer system 18 to provide initial intelligence and guidance information concerning targets 12 or other parameters. Typically, initiator system 24 provides initial detection of targets 12 and a selective release of pursuers 10.

The general assumptions and context of the problem to be solved having been described in connection with FIG. 1 and the apparatus and method of solution having been described in connection with FIG. 2, consider now assignment of pursuers 10 against targets 12 is effected. As pursuers 10 approach targets 1, each pursuer will begin to develop a picture of its encounter with targets 12. Typically, one observational dimension concerning the position and velocity of targets 12 will be resolved earlier than any remaining dimension.

Throughout this specification the word, "dimension", will be defined to include three dimensional position, vectorial velocity or other observational parameters used to identify targets 12.

The dimension which is first resolved will be referred to as the X dimension, and the dimension or dimensions which are later resolved in time referred to generally as Y dimension.

During the initial launch phase and prior to assignment, it is expected that at least some of targets 12 will be close enough together in the X dimension so that they cannot be resolved one from another in that dimension. Therefore, full resolution in the X dimension will not be achieved until a later time in the engagement when resolution may occur in the Y dimension. Resolution in any dimension, including the Y dimension is a function of only the sensor characteristics and evolving engagement geometry. An assignment in the Y dimension can be made as soon the targets are close enough to allow the second dimension resolution. For example, the angular separation between two targets flying in a formation grows as the pursuer nears the targets. If this is the second measured dimension, the final assignment should be made as soon as the angular separation is sufficient for the sensor to resolve the targets.

According to the methodology of the invention, as pursuers 10 approach targets 12, the range between them becomes small enough that target tracking system 16 within each pursuer will be capable of detecting all targets 12 which are resolvable in the X dimension and the preliminary assignment will then be made.

During preliminary assignment, each pursuer 10 independently constructs an ordered list of targets which it has thus far detected and resolved. The ordering is by the target's position in the observed dimension X. At this time in the encounter, each pursuer 10 has approximately the same list of targets. Assume that the number of listed targets is L. L will be equal to or less than the actual number N of targets 12.

Consider now the Kth pursuer among the M pursuers 10. The Kth pursuer knows that it is the Kth pursuer and that there are at least K-1 other pursuers of targets 12. The Kth pursuer then self selects its preliminary assignment pursuant to software control within computer system 18 by the following methodology. If the detected number, L, in the list of targets 12 is less than its rank, K, then the Kth pursuer will set a force-to-assign flag within computer system 18. The pursuer will then set a variable, such as K1, equal to its rank, K. K1 will then be decremented by the number L of detected targets 12 until it is less than or equal to L. At the point that K1 is less than or equal to L, pursuer K will then assign itself to the K1th target on the list.

A numerical example in the context of FIG. 1 will exemplify the preliminary assignment methodology. Assume that the six pursuers directed against the five targets is able to separately resolve the five targets as four separate incoming missiles in the observational dimension X. Table 1 below shows a list of the four targets, A Γ which have been resolved in the preliminary assignment by each of the pursuers 10.

TABLE 1

| Preliminary Assignment | |
|---|---|
| Resolved Targets' List, L = 4 | Pursuer Assignments |
| 1. A | 1, 5 |
| 2. B, Γ | 2, 6 |
| 3. [illegible] | 3 |
| 4. [illegible] | 4 |
| (a) K = 6, the 6th pursuer set flag K1 = 6 decrement by 4 K1 = 2 | |
| 6th pursuer assigns itself to B, Γ | |
| (b) K = 5, the 5th pursuer set flag K = 5 decrement by 4 K1 = 1 | |
| 5th pursuer assigns itself to A. | |
| (c) K = 4, 3, 2, or 1, fourth through first pursuers flag not set K1 = 4, 3, 2, 1 respectively. | |
| 4th pursuer assigns itself to [illegible] | |
| 3rd pursuer assigns itself to [illegible] | |
| 2nd pursuer assigns itself to B, | |
| 1st pursuer assigns itself to A. | |

Consider the preliminary assignment thus made by the sixth ranked pursuer. Since L is less than 6, the 6th ranked pursuer sets its force-to-assign flag, lets K1=6, and decrements K1 by 4, leaving K1 equal to 2. Since K1 is now less than 4, the 6th ranked pursuer assigns itself to the second listed targets, B and Γ which are unresolved at this point in time.

Similarly, the fifth ranked pursuer sets its force-to-assign flag and will assign itself to the first target, A.

However, for the first four ranked pursuers, the force-to-assign flag will not be set. Since the rank of each of these pursuers is less than a number L of targets in the list, each of these pursuers will assign itself to the same target or targets as its own rank.

The result is that targets A, B and Γ have been doubly assigned, targets Б and Д have been singly assigned.

The result of the preliminary assignment is that the Kth pursuer selects its preliminary assignment by circularly counting K items down the list of L targets, returning and restarting its count at the top of the list whenever it reaches the bottom before its count has equalled its own rank. The force-to-assign flag is set if the pursuer does have to cycle through the list in order to obtain a self assignment.

Following the preliminary assignment, each pursuer 10 continues to the encounter of targets 12 using a conventional pursuit strategy to intercept their self-assigned preliminary assignment target.

However, during this time, each pursuer uses its sensor or target tracking system 16 only on its preliminary assignment in an attempt to determine if that assignment is really more than one target through resolution in the next- to-be-resolved observational dimension Y.

During the final targeting assignment, if it becomes possible to resolve the preliminary assignment in dimension Y, a pursuer then reassigns itself as follows. If the pursuer has its force-to-assign flag set, then it reassigns itself to that newly resolved target which has the greater displacement in the Y dimension. If the force-to-assign flag is not set then the pursuer reassigns itself to that target which has the lesser displacement in the Y dimension.

Return again to our specific example as depicted in Table 1 above. Assume that the second incoming targets Γ and B are unresolved. Both the second ranked and sixth ranked pursuers have self-assigned themselves to targets B and Γ during the preliminary assignment. Now, assume that targets B and Γ become resolvable in the Y dimension. The second ranked pursuer, which has not set its flag, will pick that one of the two targets B and Γ which has the smaller displacement in the Y dimension. The sixth ranked pursuer, which has set its flag, will pick the other one of the two targets B and Γ which has the greater displacement in the Y dimension. By definition when the target is resolved, the dimensions in the Y direction are distinguishably different.

The reassessment of target assignment continues as the targets resolve themselves as convergence is approached. The self-assignment process is discontinued within pursuers 10 only at a predetermined time prior to convergence.

The remaining pursuers, which fail to resolve their preliminary assignments into additional numbers of targets, continue to perform their initial intercept strategy to the preliminarily assigned target.

In the specific numerical example described in connection with Table 1, a very small number of targets and pursuers have been described for ease of understanding. If a much larger number of pursuers were available, the possibility of multiple assignments of the pursuers to the targets even as they become resolved would continue. For example, had their been enough pursuers such that three pursuers had been preliminarily targeted to targets B and Γ , after resolution the final assignment would have assigned one of the pursuers to B and the other two pursuers to Γ. Similarly, if there were twelve pursuers available against the five incoming targets, each of the preliminarily assigned four groupings of targets would have three pursuers allocated thereto. As the resolution of targets increased targets A, Д and Б would continue to have three pursuers assigned to each of them while the three pursuers assigned to B and Γ would later reassign themselves between these two targets.

Any method of preliminary assignment which results in a nearly uniform number of pursuers being assigned to each target resolved in the first dimension could be used. By "nearly uniform" it is meant that a pursuer should not count any particular target three times before counting all other targets at least twice, i.e. the maximum number of times a pursuer can count any given target more than any other target is once.

In addition to a nearly uniform counting scheme, the only other point which must be observed is that all pursuers use the same counting logic.

Figure 3:
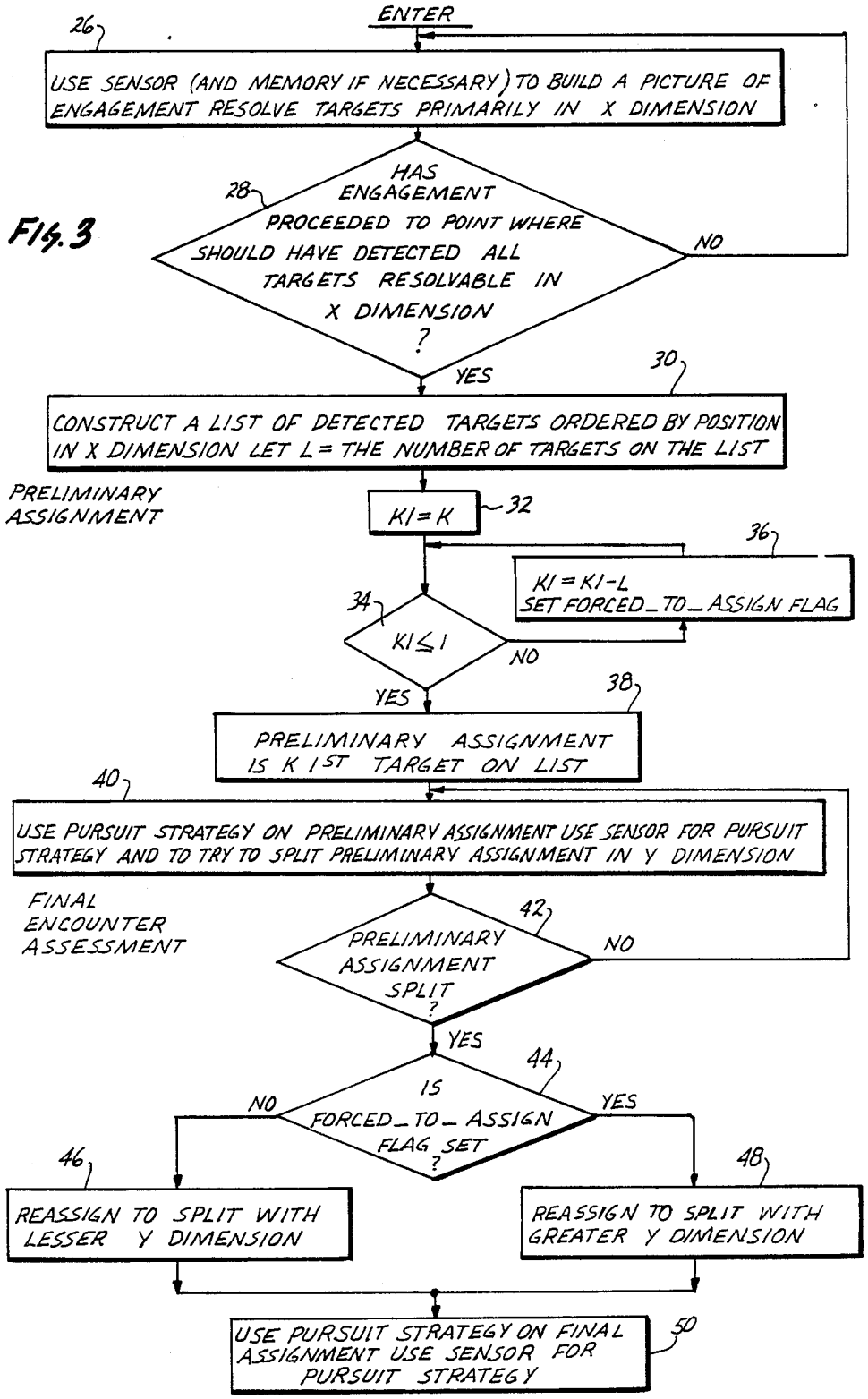
FIG. 3 is a flow chart of the methodology practiced within each pursuer in the apparatus as shown in FIG. 2.

The methodology which is implemented within the apparatus of FIG. 2 is depicted in detail in the flow chart of FIG. 3. At step 26 target tracking system 16 is used in combination with computer system 18 to develop an analysis or picture of the engagement scenario with targets 12 in the X dimension. The target tracking system continues to analyze the engagement picture until step 28 where it determines that the engagement analysis has matured to the point where all detected targets have in fact been resolved at least in the X dimension. A list which is inclusive of all the targets 12 can now be assembled and is constructed at step 30. The list having been constructed is enumerated and then ordered in the X dimension.

The preliminary assignment methodology is then entered by setting the variable K1 equal to the rank of the pursuer at step 32. The rank of the pursuer is compared at step 34 against the length of the list. If the rank exceeds the list length, the force-to-assign flag is set and K1 is decremented by the length of the list at step 36. Reexamination of K1 then returns to step 34 as just described. Ultimately, K1 will be reduced to a value below the length of the list. At this point a preliminary assignment is then made at step 38 as depicted in the illustrated example at Table 1 above At this point, each of the pursuers then enters into a final encounter assessment. Each pursuer begins to apply a strategy based upon its preliminary assignment to pursue the preliminarily assigned target and to attempt to try to split or resolve the preliminary target in another dimension, namely the Y dimension, as depicted at step 40. An inquiry is made at step 42 whether the preliminary assignment has yet been split. If not, pursuit strategy continues and further attempts at resolution will be made as described in connection with step 40. If at any time a split can be made, an inquiry is then made within the pursuer at step 44 whether or not the force-to-assign flag has been set. If the flag is not set, the pursuer is assigned to the split target with the lesser wide dimension at step 46 or if the flag has been set, is reassigned to the split target with greater wide dimension at step 48. Thereafter a conventional pursuit strategy and the final assignment is utilized through the pursuer's tracking system as diagrammatically symbolized by step 50.

In the illustrated embodiment only two dimensions were utilized in the assignment methodology. More than two dimensions can be accommodated by modifying the assignment methodology described above to count the number of times a pursuer has cycled completely through the ordered list of targets. Instead of keeping track of a forced-to-assign flag, the counted number of cycles through the list could then be used to drive logic for levels of assignment in a third or more dimensions. The benefits of such higher order assignments is not expected to be great unless each pursuer develops the same picture of analysis of the engagement as a function of time.

Many modifications and alterations may be made by those having ordinary skill in the art without departing from the spirit or scope of the invention. The illustrated example is thus shown only for the purposes of example and should not be taken as limiting the invention which is defined by the following claims.

I claim:

1. A method for use with a plurality of self-guided pursuers for self-assigning multiple targets grouped in clusters among multiple pursuers comprising the steps of:

resolving said multiple targets in an ordered sequence of elements mapped into a first dimension corresponding to said targets;

preliminarily and cyclically assigning said multiple pursuers to said elements of said ordered sequence of multiple targets, said multiple pursuers being cyclically assigned to said elements of said ordered sequence of targets, said highest ordered target being considered adjacent said lowest ordered target for purposes of said step of cyclically assigning;

resolving in a second dimension each of said clusters of targets to form a similar ordered sequence of said targets within each cluster mapped in said second dimension; and reassigning said pursuers preliminarily assigned to each cluster wherein said cluster is resolved into separate target elements by said step of resolving said cluster in said second dimension, whereby the probability that more of said targets will be assigned to at least one of said pursuers and fewer ones of said targets will be selected by more than one of said pursuers is substantially increased.

2. The method of claim 1 where said step of preliminarily assigning said pursuers to said targets comprises the steps of:

assigning a rank to each pursuer;

comparing said rank of each pursuer against the number of elements within said ordered sequence in said first dimension;

setting a flag if said rank exceeds said number of elements in said ordered sequence; and decrementing said rank by the number of elements in said ordered sequence to obtain a new value.

3. The method of claim 2 further comprising the steps of substituting said new value for said rank of said pursuer and repeating said steps of comparing, setting and decrementing until said new value is less than or equal to the number of elements in said first ordered sequence.

4. The method of claim 2 where said step of preliminarily assigning said pursuer to said targets comprises the step of assigning said pursuer to one of said clusters within said first ordered sequence according to said rank of said pursuer.

5. The method of claim 3 where said step of preliminarily assigning said pursuer to said targets comprises the step of assigning said pursuer to one of said clusters within said first ordered sequence according to said rank of said pursuer.

6. The method of claim 5 comprising the steps of:

using a pursuit strategy for each pursuer as applied to said cluster of targets according to said preliminary assignment; and testing said flag set during said step of setting when said step of resolving said targets in said cluster in said second dimension indicates two or more targets within said cluster.

7. The method of claim 6 where said step of reassigning said pursuers to targets within said cluster comprises the steps of:

reassigning each pursuer, originally assigned to said cluster, to one of said targets within said cluster, said one target having the least magnitude in said second dimension, said pursuer reassigned if said flag corresponding to said pursuer is not set; and reassigning each other pursuer to targets within said cluster having a magnitude in said second dimension greater than said least magnitude of said second dimension in said second ordered sequence if said corresponding flag of said pursuer is set.

8. The method of claim 7 further comprising the step of using a final pursuit strategy within each said reassigned pursuer with respect to said newly resolved targets in said second dimension.

9. A method for selfassigning a plurality of pursuers among a plurality of targets, wherein each pursuer is self-guided and does not communicate with other pursuers among said plurality of pursuers, wherein each pursuer senses the magnitude of at least a first and second dimension of said targets, said method comprising the steps of:

resolving said plurality of targets into a subplurality of clusters mapped into said first dimension;

preliminarily assigning said plurality of pursuers among said resolved clusters of said targets resolved in said first dimension;

resolving each of said clusters verified with respect to said first dimension into a plurality of separate targets mapped into said second dimension;

reassigning said pursuers preliminarily assigned to each cluster among said newly resolved targets mapped into said second dimension; and using an intercept strategy to converge each of said pursuers with each of said reassigned targets.

10. The method of claim 9 where in said step of preliminarily assigning said pursuers, said pursuers are distributed among said clusters of targets resolved in said first dimension so that no cluster has more than one more pursuer assigned thereto than that cluster of targets with the minimum number of pursuers assigned to it.

11. The method of claim 10 where in said step of resolving said targets in said first dimension further comprises the step of ordering said resolved clusters into an ordered sequence according to the magnitude of said first dimension corresponding to each cluster.

12. The method of claim 11 where in said step of preliminarily assigning said pursuers to said targets, said pursuers ar assigned to said subplurality of clusters of targets by assigning a rank to each pursuer and cyclically distributing said ranked pursuers among said clusters until the number of pursuers is exhausted.

13. The method of claim 9 where said step of reassigning said pursuers comprises the steps of distinguishing said pursuers into a first and second class and assigning said resolved targets with respect to said second dimension into an ordered sequence according to the magnitude of said second dimension associated with each resolved target;

assigning said first class of pursuers to a first selected portion of said ordered sequence of targets resolved in said second dimension; and assigning said second class of pursuers to a second portion of said ordered sequence of targets resolved in said second dimension.

14. The method of claim 12 where said step of reassigning said pursuers comprises the steps of:

distinguishing said pursuers into a first and second class;

assigning said resolved targets with respect to said second dimension into an ordered sequence according to the magnitude of said second dimension associated with each resolved target;

assigning said first class of pursuers to a first selected portion of said ordered sequence of targets resolved in said second dimension; and assigning said second class of pursuers to a second portion of said ordered sequence of targets resolved in said second dimension.

15. An apparatus for. use with a plurality of self-guided pursuers for self-assigning multiple targets grouped in clusters among multiple pursuers comprising:

means for resolving said multiple targets in an ordered sequence of elements mapped into a first dimension corresponding to said targets;

means for preliminarily and cyclically assigning said multiple pursuers to said elements of said ordered sequence of multiple targets, said means for assigning coupled to said mean for resolving in said first dimension, said multiple pursuers being cyclically assigned to said elements of said ordered sequence of targets, said highest ordered target being considered adjacent said lowest ordered target for purposes of said cyclically assigning;

means for resolving in a second dimension each of said clusters of targets to form a similar ordered sequence of said targets within each cluster mapped in said second dimension; and means for reassigning said pursuers preliminarily assigned to each cluster wherein said cluster is resolved into separate target elements by resolving said cluster in said second dimension, said means for reassigning coupled to said means for resolving in said second dimension and to said means for assigning, whereby the probability that more of said targets will be assigned to at least one of said pursuers and fewer ones of said targets will be selected by more than one of said pursuers is substantially increased.

16. The apparatus of claim 15 where said means for preliminarily assigning said pursuers to said targets comprises:

means for assigning a rank to each pursuer;

means for comparing said rank of each pursuer against the number of elements within said ordered sequence in said first dimension, said means for comparing coupled to said means for assigning;

means for setting a flag if said rank exceeds said number of elements in said ordered sequence, said means for setting coupled to said means for comparing; and means for decrementing said rank by the number of elements in said ordered sequence to obtain a new value, said means for decrementing coupled to said means for assigning said rank.

17. The apparatus of claim 16 further comprising means for substituting said new value for said rank of said pursuer, said means for substituting coupled to said means for assigning said rank, said means for comparing, setting and decrementing performing those respective functions until said new value is less than or equal to the number of elements in said first ordered sequence.

18. The apparatus of claim 16 where said means for preliminarily assigning said pursuer to said targets comprises means for assigning said pursuer to one of said clusters within said first ordered sequence according to said rank of said pursuer.

19. The apparatus of claim 17 where means for preliminarily assigning said pursuer to said targets comprises means for assigning said pursuer to one of said clusters within said first ordered sequence according to said rank of said pursuer.

20. The apparatus of claim 19 comprising:

means for using a pursuit strategy for each pursuer as applied to said cluster of targets according to said preliminary assignment, said means for using coupled to said means for assigning; and means for testing said flag set in combination with said means for setting when said means for resolving said targets in said cluster in said second dimension indicates two or more targets within said cluster, said means for testing coupled to said means for setting said flag.

21. The apparatus of claim 20 where said means for reassigning said pursuers to targets within said cluster comprises:

means for reassigning each pursuer, originally assigned to said cluster, to one of said targets within said cluster, said one target having the least magnitude in said second dimension, said pursuer reassigned if said flag corresponding to said pursuer is not set; and means for reassigning each other pursuer to targets within said cluster having a magnitude in said second dimension greater than said least magnitude of said second dimension in said second ordered sequence if said corresponding flag of said pursuer is set.

* * * * *